United States Patent [19]

Silberman et al.

[11] 4,239,083

[45] Dec. 16, 1980

[54] METHOD AND APPARATUS FOR ROTATING TUBING CONDUITS

[75] Inventors: Raphael J. Silberman, Houston, Tex.; Frederick T. Tilton, La Habra, Calif.; Everett H. Smith, Houston, Tex.

[73] Assignee: Baker International Corporation, Orange, Calif.

[21] Appl. No.: 36,963

[22] Filed: May 7, 1979

[51] Int. Cl.[3] ..... E21B 43/00

[52] U.S. Cl. ..... 166/117.7; 166/242; 285/39; 285/272

[58] Field of Search ..... 64/23, 28 R; 285/39, 285/281, 272; 166/117.7, 238, 239, 313, 315, 189, 208, 212, 237, 242

[56] References Cited

U.S. PATENT DOCUMENTS

| | | | |
|---|---|---|---|
| 3,266,571 | 8/1966 | John et al. | 166/223 X |
| 3,322,006 | 5/1967 | Brown | 166/117.7 |
| 3,851,714 | 12/1974 | Visser | 173/164 |

*Primary Examiner*—William F. Pate, III
*Attorney, Agent, or Firm*—William C. Norvell, Jr.

[57] ABSTRACT

An apparatus which is carriable on a tubing string extendible within a subterranean well, wherein the tubing string has an upper tubing section which is extendible from and above the apparatus to the top of the well, and a lower tubing section which is extendible from and below the apparatus. The apparatus is manipulatable to rotate the lower tubing section without rotating the upper tubing section and comprises first and second housings, one of the housings and the lower tubing section being rotatable relative to the other of the housings. Actuator means are insertable within at least one of the housings for applying rotation to one of the housings. Co-engaging means are provided on the actuator means and one of the housings for applying rotational force to one of the housings and the lower tubing section to rotate the one housing and the lower tubing section without rotating the other of the housings and the upper tubing section.

10 Claims, 3 Drawing Figures

METHOD AND APPARATUS FOR ROTATING TUBING CONDUITS

CROSS-REFERENCE TO RELATED APPLICATIONS

This application is related in subject matter to co-pending applications: Ser. No. 36,964, filed May 7, 1979, entitled "Single Trip Tubing Hanger Assembly"; Ser. No. 36,908, filed May 7, 1979, entitled "Latch Assembly And Method"; Ser. No. 36,909, filed May 7, 1979, entitled "Control Tool"; and Ser. No. 36,910, filed May 7, 1979, entitled "Method and Apparatus For Carrying First And Second Weight Loads Of A Tubing String", each of said co-pending applications being assigned to the same assignee as the present invention.

BACKGROUND OF THE INVENTION:

1. Field Of The Invention:

The invention relates to a method and apparatus for rotating a tubing conduit within a subterranean well.

2. Description of the Prior Art:

In the production of well fluids, such as oil and/or gas, from wells, it has been the practice to provide automatically closeable shut-off or safety valves which are located downhole in the well and are held open by control fluid pressure, the valves closing automatically when control fluid pressure is purposely reduced to allow the valves to close or damage occurs to the control fluid system at the well head or on an offshore platform. Such valves are employed below the well head, and in the case of offshore wells, the valves are installed below the mud line at such depth as may be desired or established by regulation, so that in the event of damage of the well caused by shifting earth or subsidence, or well head catastrophe, the well can be shut in to avoid loss of valuable well fluids into the water, and also, to avoid contamination of the water and the shore.

Many offshore wells are produced from spaced well zones through separate strings of production tubing, and a safety or shut-off valve is required for each zone. Since, from time-to-time, it is necessary to perform various remedial operations through the tubing strings, it is preferred that the safety valves be easily removed from the well for service or repair. Accordingly, commercially available safety or shut-off valves have been provided which have been run into the well casing on production tubing and landed in a tubing hanger which supports the greater weight of the downwardly extending production tubing strings. Typically, such a tubing hanger has been run into the well casing on a setting tool to a desired location, and, in the case of an offshore well, to a prescribed depth below the mud line. In such an apparatus, the tubing hanger is anchored in the well casing and the setting tool is released from the tubing hanger and removed from the well. The tubing hanger provides a seat for the safety or shut-off valve assembly which is run into the well on an upward extension of the production tubing and landed in the tubing hanger, subsequent to the setting of the hanger and retrieval of the hanger setting tool.

Typical of such prior art apparatuses is that as disclosed in U.S. Pat. No. 3,771,603, issued Nov. 13, 1973, entitled "Dual Safety Valve Method and Apparatus", to Talmadge L. Crowe, the disclosure of which is hereby incorporated herein by reference. The necessity of two trips into the hole with work strings and/or other means to first carry and anchoringly set the tubing hanger and thereafter land the conduits containing the safety valves therein is an economic deterrent since considerable rig time is expended in running a first work string and/or other means for anchoring the hanger, retrieving the work string and/or other means, and thereafter running the production tubing containing the safety valve or valves into sealing engagement with the hanger.

The tubing hanger incorporates means for hydraulically releasing the latch assembly for retrieval of the production tubing string extending to the top of the well which has been initially sealingly landed within the tubing hanger. The latch assembly also has auxiliary mechanical disengaging means which may be activated in the event of failure of the latch assembly to disengage from the tubing hanger by hydraulic means.

The mechanical release backup feature of the latch assembly incorporates a swivel sub apparatus which permits rotation of the section of production tubing immediately above the tubing hanger when the production tubing is secured into the surface hanger at the top of the well.

SUMMARY OF THE INVENTION

The present invention is directed to an apparatus for rotation of a lower tubing section without rotating an upper tubing section extending thereabove. It is particularly unique in application when incorporated in a mechanical backup unlatching feature of a latch assembly, the latch assembly typically being incorporated for selective unlatching and relatching of a tubing hanger in a subterranean well. The swivel apparatus is carriable on a tubing string which is extendible into the subterranean well, with the tubing string having an upper tubing section extending from and above the swivel apparatus to the top of the well, and a lower tubing section extendible from and below the swivel apparatus, to the tubing hanger means. The swivel apparatus comprises first and second housings, with one of the housings and the lower tubing section being rotatable relative to the other of the housings. Actuator means are insertable within at least one of the housings for applying rotation to one of the housings. Coengaging means are carried on the actuator means and one of the housings for applying rotational force to one of the housings and the lower tubing section without rotating the other of said housings and said upper tubing section. The swivel apparatus may be manipulated, when incorporated within a tubing string carrying a mechanical backup feature of a latch assembly on a tubing hanger means, to rotate the lower tubing section to transmit rotational force to the latch assembly to effect relative movement between component parts for shifting the latch assembly into unlatched position relative to the tubing hanger means, such that the tubing string may be retrieved from sealing engagement within the tubing hanger means, to the top of the well.

DESCRIPTION OF THE PREFERRED EMBODIMENTS

Figure 1:
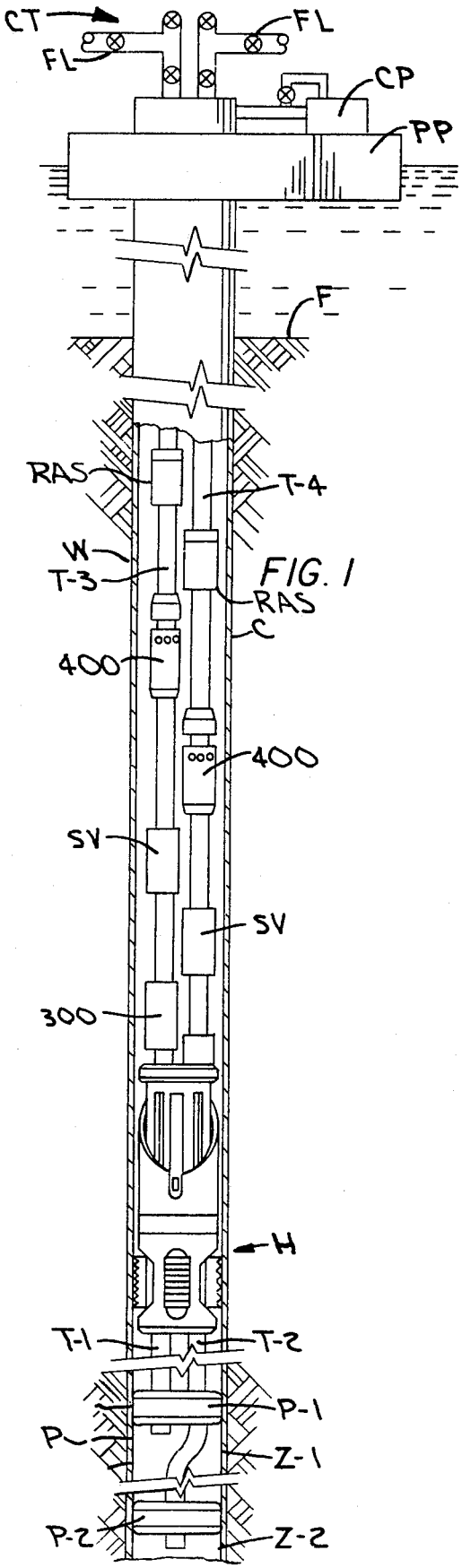
FIG. 1 is a diagrammatic illustration showing a single trip tubing hanger assembly installed in a well casing extending through vertically spaced productive well zones which are isolated from one another by packers, and from which well fluids are produced through a pair of production tubing strings, a swivel apparatus being shown on one of the strings above the tubing hanger means.

Referring now to FIG. 1, a well bore W extends downwardly into the earth below the ocean floor F through vertically spaced well fluid producing zones Z-1 and Z-2. A casing C is set in the well bore and perforations P in the casing establish communication between the production zones Z-1 and Z-2 and the casing C. Set in the casing C is an upper packer P-1 located above the production zone Z-1 and a lower packer P-2 located in the casing between the production zones Z-1 and Z-2. A first production tubing string T-1 extends from a tubing hanger H through the packer P-1 and opens into the casing therebelow to communicate with the production zone Z-1, and a second production tubing T-2 extends downwardly from the tubing hanger H through the upper packer P-1 and downwardly through the lower packer P-2 into the casing therebelow for communication with the production zone Z-2. The tubing strings T-1 and T-2 may extend a number of thousands of feet downwardly in the casing C to the packers P-1 and P-2, and the tubing strings T-1 and T-2 are supported by the tubing hanger assembly H which is set or anchored in the well casing and forms a seat for plural safety valves SV for the respective tubing strings T-1 and T-2. The hanger assembly H and the valve assemblies SV are located below the ocean floor F or the mud line of a body of water, at a desired or required depth of about 500 to 1,000 feet, more or less. The casing C extends upwardly through the water to a production platform or barge PP. However, as is well known, the well may be completed at the ocean floor and one or a number of additional casings (not shown) may be set in larger diameter well bores, and the casing C may be suspended or hung from a casing hanger located at the ocean floor, in which case a conductor pipe or other casing (not shown) may extend to the production platform PP. In any event, upper production fluid tubings T-3 and T-4 extend upwardly from the hanger assembly H and are connected with christmas trees CT on the platform PP whereby the flow of well fluids from the well zone Z-1 and Z-2 may be controlled or manually shut off. Flow lines FL are provided to conduct well fluids from the christmas trees CT to suitable reservoirs or tanks (not shown).

The respective subsurface safety valves SV, which are normally closed, are adapted to be held open, to enable the flow of production fluids therethrough, by means of control fluid pressure supplied through a control fluid conduit (not shown), or through a pair of such conduits, from a source of control fluid pressure at a control panel CP on the platform PP. So long as the control fluid pressure is adequate to maintain the subsurface valves SV open, well fluids may flow from the zone Z-1 and Z-2 to the respective flow lines FL, but, if it is desired for any reason to close either of the shut-off valves SV, or in the event of damage of the control fluid tubing, the control fluid pressure may be varied so that the subsurface valves SV are automatically closed, thereby shutting the well in at a location below the ocean floor, to prevent continued production fluid flow.

The valve assemblies SV may be retrieved from the tubing hanger apparatus H so that under circumstances requiring repair or service of the valves SV, it is not necessary to pull the production tubing strings T-1 and T-2. Since only the comparatively short upper production tubing strings T-3 and T-4 need be pulled, selectively, or together, from the well to remove one or more of the valves SV, and the substantially longer production tubing strings T-1 and T-2 remain in the well, the platform PP need not be equipped with or supplied with high-powered hoisting apparatuses. Instead, the platform PP may simply be provided with a small relatively low-powered hoist mechanism or a gin pole hoist. In addition, the tubing strings T-1 and T-2 may be plugged off at or below the hanger H with bypass plugs in sealing nipples to enable the service or repair of the safety valves SV, without requiring that the well be killed.

As also shown in FIG. 1, the tubing strings T-3 and T-4 are sealingly engaged within a split surface hanger (not shown) below the christmas tree CT and adaptable to be landed within the casing C in a profile or surface hanger bowl (not shown) subsequent to anchoring engagement of the hanger assembly H. The split surface hanger is utilized to suspend the tubing weight from the tubing head on the platform PP and the surface hanger bowl carries the tubing weight above the tubing hanger H when the split surface hanger is in position within the bowl.

One or both of the tubing strings T-3 and T-4 may carry rotational adjustment subs RAS somewhat below the split surface hanger in order to space out the tubing strings T-3 and T-4 from the surface hanger to the tubing hanger H to permit extension or contraction of the tubing length prior to setting of the hanger H. As an alternative to utilization of a rotational adjustment sub RAS, a conventional slip joint may be incorporated into one or both of the strings T-3 and T-4.

Below the rotational adjustment subs RAS on each of the strings T-3 and T-4 is defined a shear-out safety joint 400 which is utilized to part the respective tubing strings T-3 and T-4 above the safety valves SV for retrieval to the top of the well W in the event of a disaster. The shear-out safety joints 400 automatically separate when the weight load strength of the tubing string is exceeded, or other predetermined load carried therethrough.

Below the shear-out safety joints 400, and at a depth below the ocean or other floor F, are conventinal tubing mounted or wireline safety valves SV carried on each of the tubing strings T-3 and T-4. The utilization of any particular tubing mounted or wireline safety valves is not critical to the present invention. The safety valves SV utilized with the present invention may be those as described in detail in U.S. Pat. No. 3,771,603.

One or more of the tubing strings T-3 and T-4 may carry optional swivel subs 300 spaced thereon and below the safety valves SV as an alternate means to mechanically disengage the latch L from the tubing hanger H.

Below the swivel subs 300 is the tubing hanger H which is provided to anchor against the interior wall of the casing C and thereafter carry the weight of the tubing strings T-1 and T-2 therebelow. Seating nipples (not shown) are carried on the tubing strings T-1 and T-2 below the tubing hanger H and are provided with nipples for receipt of plugging means (not shown) which are landed therein by wireline prior to unlatching of the latch L from the tubing hanger H or prior to the setting of the tubing hanger H.

Thus, it can be seen that the tubing hanger assembly generally comprises an upper space-out section, consisting of tubing strings T-3 and T-4 and component parts carried thereon, a tubing hanger H receiving the latch assembly L, and the lower section, consisting of the tubing hanger H and tubing strings T-1 and T-2, and component parts carried thereon.

The hanger H utilized in the present invention is adapted to latchingly and sealingly receive the space-out section 100A at its uppermost end and is anchoringly engageable upon the casing C exteriorly defined therearound, in order to transfer the weight of the tubing strings T-1 and T-2 therebelow to the casing C, thus permitting retrieval of the space-out section 100A without retrieval of the tubing strings T-1 and T-2 therebelow. The tubing hanger H is of known design and is as disclosed in detail in U.S. Pat. No. 3,771,603.

Figure 2:
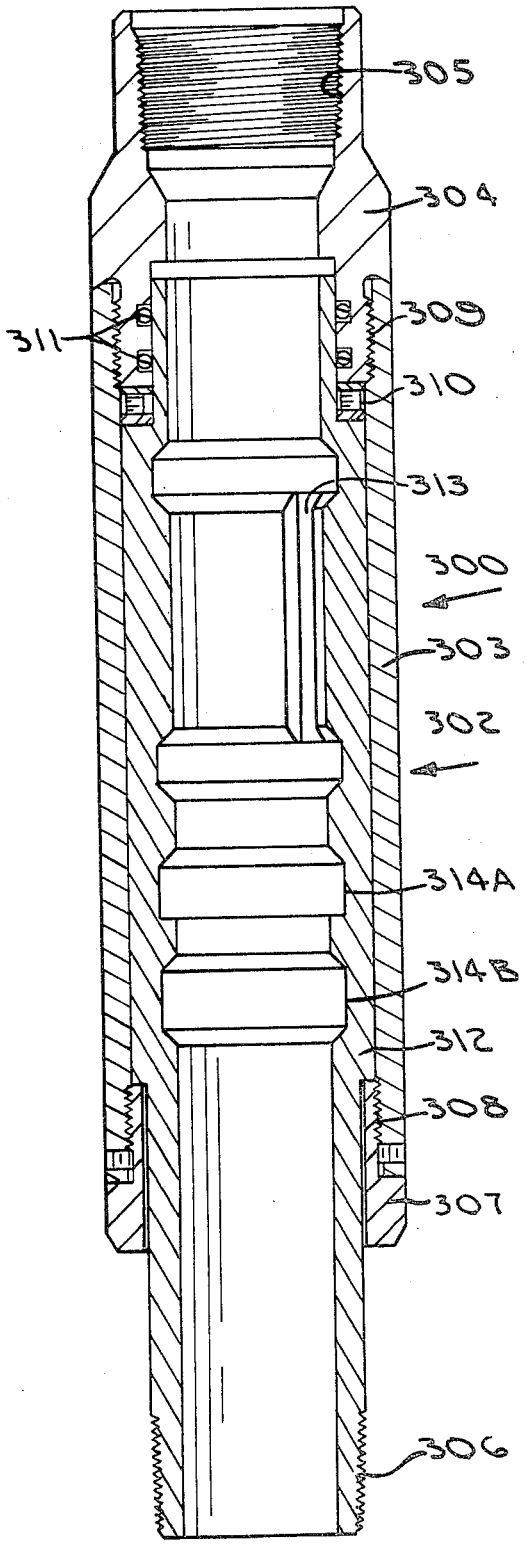
FIG. 2 is a longitudinal view of the outer and inner housings of the swivel or tubing manipulation aparatus.
Figure 3:
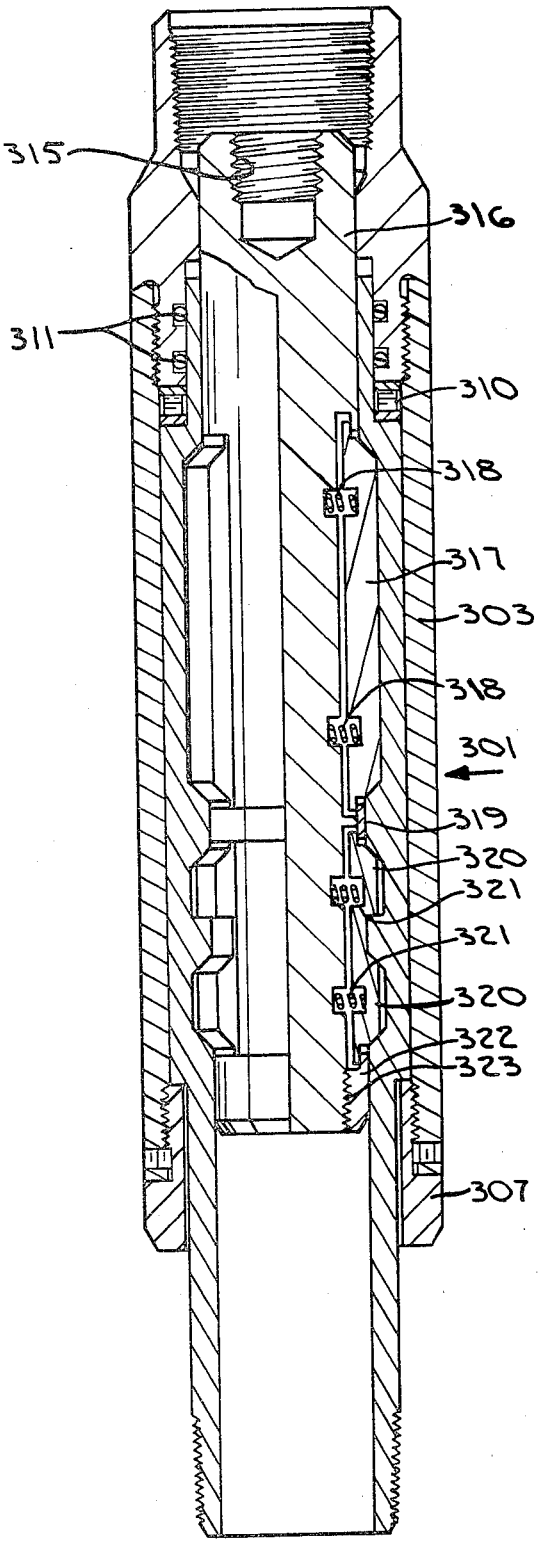
FIG. 3 is an illustration of the actuator means incorporated within the housing of the swivel joint and rotationally interengaged therewith.

As shown schematically in FIG. 1, and as detailed in FIGS. 2 and 3, the swivel sub 300 is an embodiment which may be carried on one or more of the tubing strings T-3 and T-4 somewhat below the safety valves SV. The swivel sub 300 is provided in order to be able to rotate one or both of the tubing string T-3 and T-4 between the swivel sub 300 and the latch assembly L when the tubing strings T-3 and T-4 between the swivel sub 300 and the split surface hanger are rigidly threaded into the hanger, in order to provide tubular rotation without "binding" safety valve control tubing to mechanically unlatch the latch assembly L from the hanger H, as a backup means, in the event that hydraulic unlatching is not possible or feasible.

The swivel sub 300 consists of a swivel sub housing 302 and an actuator 301. The swivel sub housing 302 consists of an outer cylindrical housing 303 which is secured by threads 309 to a top sub 304, which, in turn, is secured by threads 305 to a section of the respective tubular string T-3 and/or T-4. The outer housing 303 is secured at its lowermost end to a lower guide member 307 by means of threads 308. A spline mandrel 312 is cylindrically carried within the interior of the outer housing 303 and the lower member 307 and is secured at its lowermost end to a section of the respective tubing strings T-3 and T-4 at threads 306. In between the spline mandrel 312, the outer housing 303 and the top sub 304 is a bearing assembly 310 for minimizing transmission of torque through the swivel sub housing 302 as the tubular string is rotated. The bearing assembly 310 also is provided to sustain the weight of the tubing string above the swivel sub 300. Elastomer rings 311 are carried on the top sub 304 to prevent fluid communication between the sub 304 and the spline mandrel 312.

The spline mandrel 312 contains a series of inwardly extending circumferentially spaced and longitudinally extending spline-ways 313 which receive rotational spline dogs 317 carried on the swivel sub actuator 301 to permit interengagement between the actuator 301 and the swivel sub housing 302 to provide means for transmitting torque as a result of tubular rotation thereabove to the tubing section therebelow. Limiting grooves 314A and 314B are interiorly profiled on the spline mandrel 312 for receipt of first and second travel resistors 320 on the actuator 301 to prevent further longitudinal travel of the actuator 301 within the swivel sub housing 302.

The actuator 301 for the swivel sub 300 is carried on an auxiliary work string (not shown) which is insertable within one of the respective tubular strings T-3 and T-4 with the actuator 301 secured at the lowermost end thereof by means of threads 315. A control mandrel 316 houses a series of exteriorly extending circumferentially spaced rotational dogs 317 which are urged outwardly of the mandrel 316 by means of the force defined through springs 318 housed within the dog 317 and the mandrel 316. A spacer 319 is carried around the mandrel 316 on and below the dogs 317 and interfaces with the travel resistors 320 urged outwardly by upper and lower spring members 321 carried within the resistors 320 and the mandrel 316, the resistors 320 being also circumferentially spaced around the exterior of the mandrel 316 for companion engagement within the limiting grooves 314A and 314B to prevent further longitudinal travel of the actuator 301 within the housing 302 of the swivel sub 300. At the lowermost end of the actuator 301 is a resistor ring 322 secured to the mandrel 316 by means of threads 323.

When it is desired to rotate the tubing string below the swivel sub 300, as described below, the actuator 301 is run on the auxiliary work string until such time as the travel resistors 320 land in the grooves 314A and 314B of the housing 302. At such time, the rotational dogs 317 also have landed adjacent the splines 313 and have been interengaged therebetween. In the event that the dogs 317 and splines 313 are not interengaged, a mere rotation of the auxiliary work string will permit the dogs 317 to quickly come into interengagement with the splines 313 because of the outward urging of the dogs 317 by the spring 318. After interengagement of the dogs 317 and the splines 313, the actuator 301 is in rotational transmission alignment with the swivel sub housing 302 and continued rotation of the auxiliary work string will transmit rotational force from the work string through the swivel sub 300 to the section of the tubing string therebelow to initiate disengagement of the latch assembly L from the hanger H, as further described below.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. An apparatus carriable on a tubing string extendible into a subterranean well, said tubing string having an upper tubing section extendible from and above said apparatus to the top of the well and a lower tubing section extendible from and below said apparatus, said apparatus being manipulatable to rotate said lower tubing section without rotating said upper tubing section, said apparatus comprising: first and second housings, one of said housings and said lower tubing section being rotatable relative to the other of said housings; actuator means mechanically manipulatable by means extending to the top of the well, said actuator being insertable and removable within at least one of said housings for selectively applying rotation to one of said housings; and co-engaging means carried on said actuator means and one of said housings for applying rotational force to one of said housings and said lower tubing section to rotate said one housing and said lower tubing section without rotating the other of said housing and said upper tubing section.

2. The apparatus of claim 1 wherein the co-engaging means comprises at least one spline on one of said actuator means and one of said housings; and at least one spline dog means carried on and outwardly urged away from the other of said actuator means and the one of said housings.

3. The apparatus of claim 2 wherein plural spline dog means are carried on and outwardly urged away from the actuator means; and plural splines are on one of said housings.

4. The apparatus of claim 1 wherein said actuator means is manipulatable by an auxiliary work string insertable through said upper tubular section.

5. In an apparatus for producing a well from at least one productive zone penetrated by the well bore in which casing is set below the top of the well, said apparatus comprising tubing hanger means supporting at least one production tubing string extending downwardly in the well bore and communicating with at least one productive zone, anchor means on said tubing hanger means actuable into anchoring engagement with said casing, said tubing hanger means selectively receiving at least one upper tubing section therethrough extendible from and above said tubing hanger means to the top of the well, the improvement in rotation transmitting means carriable on said tubing string with the upper tubing section extendible from and above said rotation transmitting means to the top of the well and a lower tubing section extendible from and below said rotation transmitting means, said rotation transmitting means being manipulatable to rotate said lower tubing section without rotating said upper tubing section, said rotation transmitting means comprising: first and second housings, one of said housings and said lower tubing section being rotatable relative to the other of said housings; actuator means mechanically manipulatable by means extending to the top of the well, said actuator being insertable and removable in at least one of said housings for selectively applying rotation to one of said housings; and co-engaging means carried on said actuator means and one of said housings for applying rotational force to one of said housings and said lower tubing section to rotate said one housing and said lower tubing section without rotating the other of said housing in said upper tubing section.

6. The improvement of claim 5 wherein the co-engaging means comprises at least one spline on one of said actuator means and one of said housings; and at least one spline dog means carried on and outwardly urged away from the other of said actuator means and the one of said housings.

7. The improvement of claim 6 wherein plural spline dog means are carried on and outwardly urged away from said actuator means and plural spline means are carried on one of said housings.

8. In an apparatus for producing a well from plural productive zones penetrated by the well bore in which casing is set below the top of the well, the improvement comprising: tubing hanger means supporting a plurality of production tubing strings extending downwardly in the well bore and respectively communicating with one of said productive zones, each production tubing string having an upper tubing section extending from said hanger means to the top of the well and a lower production tubing string section respectively extending to one of said productive zones; anchor means on said tubing hanger means actuable into an anchoring engagement with said casing, the improvement comprising: rotation transmitting means carried on said upper production tubing string section, a lower tubing length of said upper production tubing string section extending from said rotation transmitting means to said tubing hanger means, said rotation transmitting means being manipulatable to rotate said lower tubing length without rotating said upper production tubing section, said rotation transmitting means comprising: first and second housings, one of said housings and said lower tubing length being rotatable relative to the other of said housings; actuator means mechanically manipulatable by means extending to the top of the well, said actuator means being insertable and removable within at least one of said housings for selectively applying rotation to one of said housings; and co-engaging means carried on said actuator means and one of said housings for applying rotational force to one of said housings and said lower tubing length to rotate said one housing and said lower tubing length without rotating the other of said housing and said upper production tubing string section.

9. In an apparatus for producing a well from plural productive zones penetrated by the well bore in which a casing is set below the top of the well, comprising: tubing hanger means supporting a plurality of production tubing strings extending downwardly in the well bore and respectively communicating with one of said productive zones, each of said production tubing strings having an upper production tubing string section extending from said hanger means to the top of the well and a lower production tubing string section extending from said hanger means respectively to each of said productive zones; anchor means on said tubing hanger means actuable into anchoring engagement with said casing; plural safety valve means carried on each of said upper production tubing string sections and each having a flow passage communicating to the respective lower production tubing string section; control fluid conduit means leading from each of said safety valves to the top of the well and connectable to a source of control fluid pressure to manipulate said safety valves between open and closed positions, the improvement comprising: rotation transmitting means carried on said upper production tubing string section, a lower tubing length of said upper production tubing string section extending from said rotation transmitting means to said hanger means, said rotating transmitting means having: first and second housings, one of said housings and said lower tubing length being rotatable relative to the other of said housings; actuator means mechanically manipulatable by means extending to the top of the well, said actuator being insertable and removable within at least one of said housings for selectively applying rotation to one of said housings; and co-engaging means carried on said actuator means and one of said housings for applying rotational force to one of said housings and said lower tubing length to rotate to said one housing and said lower tubing length without rotating the other of said housing and said upper production tubing string section.

10. In an apparatus for producing a well from at least one productive zone penetrated by the well bore in which casing is set below the top of the well, said apparatus comprising tubing hanger means supporting at least one production tubing string extending downwardly in the well bore and communicating with at least one productive zone, anchor means on said tubing hanger means actuable into anchoring engagement with said casing, said tubing hanger means selectively receiving at least one upper tubing section therethrough extendible from and above said tubing hanger means to the top of the well, latching means responsive to tubular rotation to disengage said upper tubing section from said hanger means, the improvement in rotation transmitting means carriable on said tubing string with the upper tubing section extendible from and above said rotation transmitting means to the top of the well, and a lower tubing section extending from and below said rotation transmitting means, said rotation transmitting means being manipulatable to rotate said lower tubing section without rotating said upper tubing section, said rotation transmitting means comprising: first and second housings, one of said housings and said lower tubing section being rotatable relative to the other of said housing; actuator means mechanically manipulatable by means extending to the top of the well, said actuator being insertable and removable in at least one of said housings for selectively applying rotation to one of said housings; and co-engaging means carried on said actuator means and one of said housings for applying rotational force to one of said housings and said lower tubing section to rotate said one housing and said lower tubing section without rotating the other of said housing and said upper tubing section, whereby tubing rotation may be transmitted from said lower tubing section to said latching apparatus to disengage said latching apparatus from said tubing hanger means.

* * * * *